United States Patent [19]

Petros

[11] 4,117,989

[45] Oct. 3, 1978

[54] METHOD AND APPARATUS FOR COIL HANDLING AT MILL ENTRY

[75] Inventor: Andrew J. Petros, Oakdale, Pa.

[73] Assignee: Mesta Machine Company, Pittsburgh, Pa.

[21] Appl. No.: 829,233

[22] Filed: Aug. 31, 1977

[51] Int. Cl.[2] ..... B21C 47/16

[52] U.S. Cl. ..... 242/78.8; 242/79

[58] Field of Search ..... 242/78.8, 78.7, 78.6, 242/79; 72/40

[56] References Cited

U.S. PATENT DOCUMENTS

| | | | |
|---|---|---|---|
| 2,756,943 | 7/1956 | Sieger | 242/79 |
| 2,980,360 | 4/1961 | Billetter | 242/78.8 |
| 3,038,681 | 6/1962 | Herr | 242/78.6 |
| 3,746,229 | 7/1973 | Feller | 242/78.8 |
| 3,991,951 | 11/1976 | Galletti | 242/79 |

*Primary Examiner*—Edward J. McCarthy
*Attorney, Agent, or Firm*—Howard E. Sandler

[57] ABSTRACT

A method and apparatus for coil handling at a mill entry and more particularly a method and apparatus providing improved sequencing and more positive handling in the preparation of the head end of the strip and in guiding and feeding the strip to mill production equipment.

15 Claims, 5 Drawing Figures

METHOD AND APPARATUS FOR COIL HANDLING AT MILL ENTRY

At the entry end of strip processing mills, such as in cold reduction or pickling applications, it is common to provide handling equipment to prepare a coil for feeding while another coil is simultaneously paying off to the mill production equipment. In preparing the coil for feeding a variety of operations and equipment may be necessary for example: coil opening, edge preparation of the head end of the strip; feeding and guiding the strip to a proper orientation for feeding to mill production equipment; supporting the coil being prepared and traversing it longitudinally along mill centerline to the final position for paying out to the production equipment and the like.

In some instances of coil preparation many of the operations were accomplished manually. Manual operations of this sort are generally unacceptable for obvious reasons such as danger to the personnel involved, inefficiency, expense and limitations on the types and ranges of coil which can be handled. In recognition of these problems, the prior art has taught mechanical handling to relieve manual handling in many instances. Nevertheless in these prior art systems, personnel quite often are involved in the direct handling of strip, particularly in guiding the strip from the reel to the production equipment.

Other problems in the coil preparation of prior systems was that these systems are limited in the gauge range of strip they can handle particularly in those instances where the system is set up to handle a heavy gauge strip. In these instances the head end of the strip is paid off from the coil and travels through an arcuate path to the production equipment. At least a major portion of this arcuate path is unsupported; however, the rigidity of the heavy gauge material is relied upon for primary guiding through the path. In instances where a light gauge strip is being handled by the same equipment, proper guiding of the strip will not be maintained by the equipment for the light gauge strip will bend and generally not conform to the feed path.

Further problems with some prior systems exist in the means to support and rotate the coil for feeding off strip during preparation. It is common to support the coil being prepared on rollers of an entry coil car. After coil opening and initial feeding the coil car is traversed to the final paying out position. In prior systems the support rollers on the entry coil car were powered to rotate the coil and pay out strip. This method of rotation has often caused problems such as indentations on lighter gauge strip because of the frictional driving engagement between the rollers and the periphery of the coil. Furthermore, in instances where the coil is comprised of a heavier gauge strip, the friction between the drive rollers and the coil was not always sufficient thereby resulting in slippage and a nonpositive driving arrangement. Still further, inasmuch as the power rollers on the entry coil car are raised and lowered during its support of the entry coil car and are maintained at an intermediate position during initial paying out of the strip, a constant, relatively high pressure must be maintained in the vertical power cylinders during this paying out.

Additional problems with some prior art systems are apparent in their means for initially feeding the strip to the vertical sideguides. In these instances the feeding is primarily through the resulting force from the rotation of the coil. Other than this "pushing" force there is no positive feeding force. This lack of positive feeding force, particularly in lighter gauge applications, may result in buckling of the strip or other deleterious effects.

Other inefficiencies with prior coil preparation systems are apparent in the preparation of the head end of the strip. In many of these instances the head end of the strip is prepared, such as by shearing, downstream of the coil preparation area. This location may result in a duplication of equipment and most certainly a time loss from an arrangement where the head end is prepared at the coil preparation area.

By means of the present invention the above-mentioned problems are overcome or in the least, greatly alleviated. The present invention includes a retractable mandrel which is selectively positioned in the coil center. The mandrel is rotated to pay out the strip for preparation. Accordingly, the entry car rollers may now be merely idler rollers and damage to the coil surface from roller contact will be alleviated. Furthermore the mandrel supports the coil weight and also positively drives the coil. Accordingly, the force in the vertical power cylinders of the entry coil car may be reduced and the rollers used to pinch the strip, thereby advancing the strip in a more positive fashion and reducing slippage.

The present invention additionally includes an arrangement of a driven strip flattener roller which provides a positive drive to the head end of the strip. This arrangement will reduce the occurrences of buckling with light gauge material and will aid in the guiding of the strip to the strip guideways. Further, the flattener roll cooperates with rolls on a pivoted coil opener to increase the curvature of the head end of the strip to facilitate guiding to the production equipment.

The invention herein further includes a guide apron arrangement adjacent the strip flattener roller which is adjustable to selectively direct the head end of the strip to a scrap shear or sideguides. This arrangement provides for preparation of the head end on mill centerline during the coil preparation operation thereby alleviating the necessity for duplication of machinery and possibly additional operating personnel.

Still further the invention herein provides an arrangement of vertical sideguides and longitudinal carryover sideguides which are oriented and operable in a manner to provide substantial support and guiding of the strip to the production equipment. This arrangement alleviates the necessity of manually handling of strip while simultaneously providing the capability of handling a relatively wider range of strip.

These and other objects and advantages of the present invention will become more readily apparent upon a reading of the following description and drawings in which.

Figure 1:
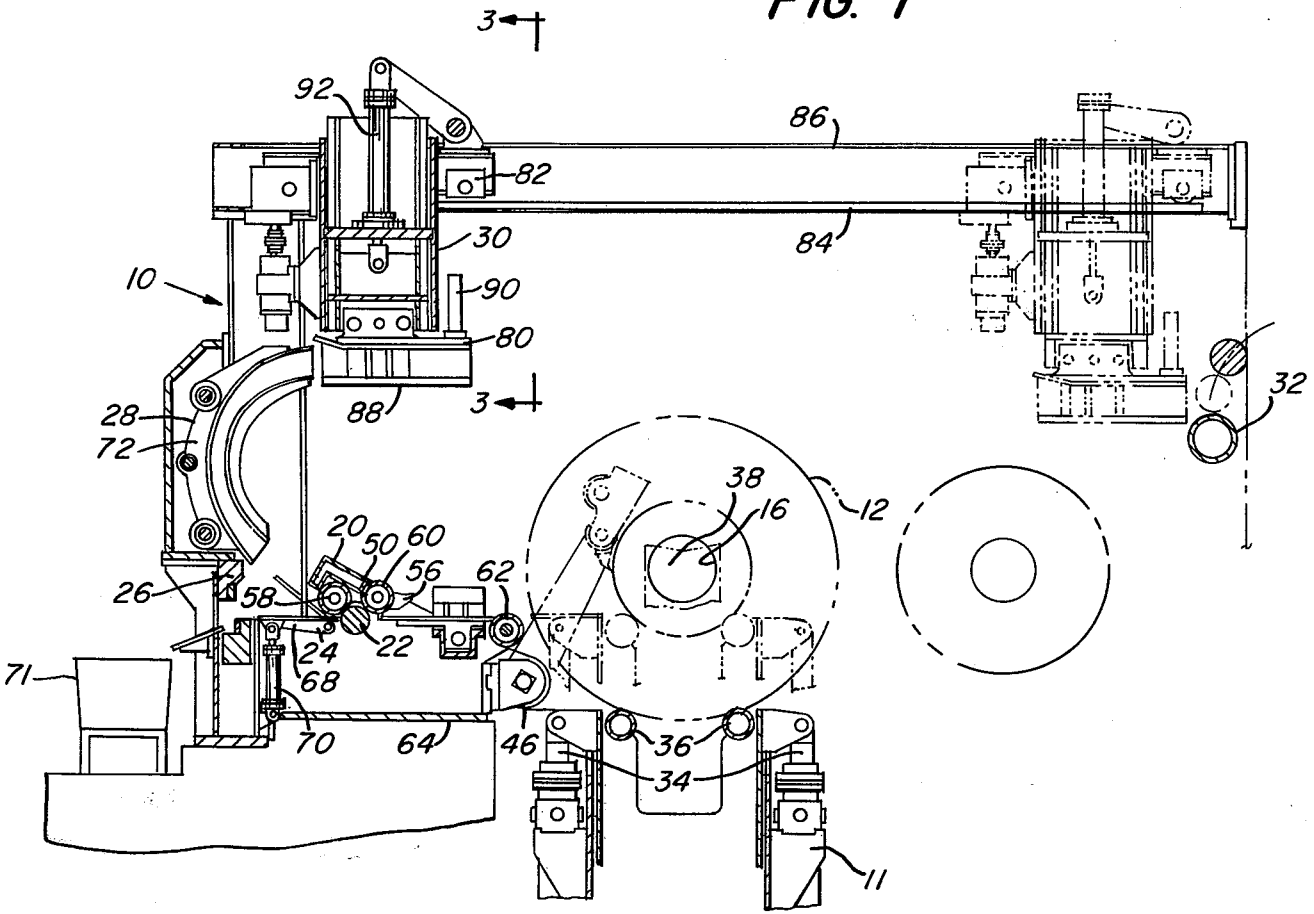
FIG. 1 is a longitudinal side elevational view, partially schematic, of a coil preparation entry end system constructed in accordance with the principles of the present invention.
Figure 2:
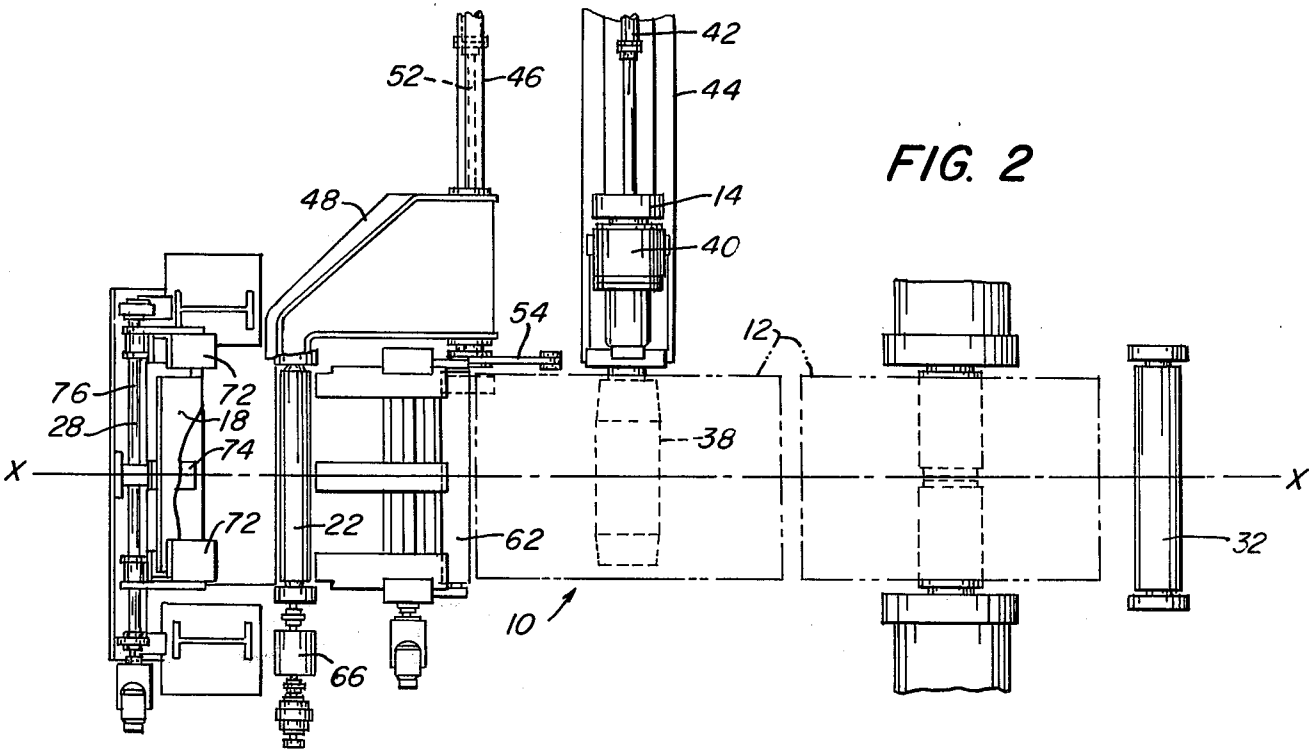
FIG. 2 is a plan view, partially schematic, of portions of the entry end system illustrated in FIG. 1.

FIGS. 1 and 2 schematically illustrates a coil preparation system of the present invention which is generally indicated at 10 and which comprises: an entry coil car 11 which receives a coil 12 thereon; a retractable preparation mandrel assembly 14 which is selectively receivable in the core 16 of coil 12 to support coil 12 and rotate coil 12 to preliminarily pay out strip 18; and a retractable and rotatable coil opener assembly 20 operable in one position to peel the head end of the strip 18 from the coil 12 and in another position to be cooperable with a powered strip flattener roll 22 to reduce the curvature of the strip 18 being paid off a coil 12 and simultaneously provide a positive driving force to strip 18 for subsequent guiding. Coil preparation system 10 additionally includes a guide apron assembly 24 which is selectively positionable to alternately guide the head end of strip 18 to a shearer assembly 26 or to vertical side-guide assembly 28. System 10 further includes a carryover sideguide assembly 30 which is movable longitudinally from a position adjacent vertical guide 28 to a downstream position adjacent the pass line mill deflector and pinch roll assembly 32.

For purposes of description herein, forward and rearward shall generally refer respectively to downstream and upstream with respect to the mill production or pass line. Furthermore, inwardly and outwardly shall generally refer respectively to towards and away from mill centerline X—X as indicated in FIG. 2. Still further operation side and equipment side shall refer respectively to the lower and upper sides with respect to mill centerline X—X as indicated in FIG. 2.

Coils 12 are fed to mill centerline X—X in any suitable manner, for example by walking beam conveyor (not shown) which extends transversely of mill centerline X—X in transverse alignment with entry coil car 11. As is illustrated in phantom in FIG. 1, when receiving a coil 12 from the walking beam conveyor, the spaced vertical extension cylinders 34 of coil car 11 are extended to raise the upper portion of car 11. The coil 12 is then seated on spaced idler rollers 36 of car 11. The cylinders 34 are then retracted thereby lowering rollers 36 and coil 12 seated thereon to the coil preparation elevation. At this instance the mandrel assembly 14 is activated to support and initially rotate coil 12 as described hereinafter. Mandrel assembly 14 is positioned on the equipment side and comprises: a mandrel portion 38; a motor portion 40 which carries and drives portion 38; and an extensible cylinder assembly 42. Motor portion 40 is seated on support member 44 and is slidable longitudinally therealong in response to the retraction or extension of cylinder assembly 42. With coil 12 positioned on idler rollers 36 as described above, the mandrel portion 38 will be in coaxial alignment with core 16 of coil 12. The cylinder assembly 42 is extended until mandrel portion 38 is received within core 16. Mandrel portion 38 is then expanded radially outwardly until the outer periphery thereof is in firm engagement with the adjacent periphery of core 16. At this point the weight of coil 12 is supported by the mandrel assembly 14. Accordingly, the force to cylinders 34 may be decreased somewhat, particularly inasmuch as the rotation for preparation of coil 12 will be accomplished by the mandrel rather than the rollers on the coil car 11 as has been done in the prior art. As will be more fully described hereinafter, in initial preparation of a coil 12 the motor portion 40 is energized to rotate the mandrel portion clockwise and hence the coil 12 therewith, to pay off the head end of the strip 18. Rotation by mandrel portion 40 rather than by powered rollers on the entry coil car 11, as has been often done in the prior art, results in substantially less damage to strip 18 being paid off the coil 12 as well as providing a more positive rotatable drive to the coil 12.

Coil opener assembly 20 comprises: an elongated pivot shaft 46 positioned on the equipment side of system 10 and extending in a direction generally normal to mill centerline X—X; a coil opener support portion 48 slidably mounted on shaft 46 for longitudinal movement therealong and having an internal portion thereof suitably keyed to an external peripheral portion of shaft 46 for rotation with shaft 46; and a coil opener member 50 having the inner end thereof carried by support portion 48 adjacent the free end of portion 48. Coil opener member 50 extends inwardly from portion 48 in a direction generally normal to mill centerline X—X. Suitable means are provided for the extension and retraction of portion 48 as well as the rotation thereof. In the embodiment illustrated such latter mentioned means are schematically shown at traversing extensible cylinder assembly 52 for the longitudinal movement of portion 48 along shaft 46 and a rotation arm assembly 54 activated by a cylinder (not shown) for the rotation of shaft 46 and of portion 48 which is rotatably keyed thereto. Coil opener member 50 includes: a suitable blade or opener member 56 on the downstream side thereof; an upper roller member 58 on the upstream side thereof; and a lower roller member 60 additionally on the upstream side thereof.

In operation after a coil 12 is received and lowered into preparation position by coil car 11, the rotation arm assembly 54 is energized to rotate shaft 46 clockwise until opener member 56 engages the outer periphery of the coil 12. Mandrel 38 is then rotated clockwise causing the head end of strip 18 to be "peeled" from the coil 12. At this instance strip 18 is guided away from the coil 12 in an upstream direction by the clockwise rotation of the mandrel 38 as well as the lower roller member 60 and a transversely extending end idler deflector roller 62 which is carried at the downstream end of a stationary substructure support 64. Upstream from idler deflector roll 62, the substructure support 64 additionally carries the transversely extending strip flattener and guide roller 22. Guide roller 22 is suitably rotatably driven such as by motor means 66.

With the head end of strip 18 "peeled" from coil 12, shaft 46 is then rotated counter clockwise until strip 18 is frictionally engaged between driven guide roller 22 on the lower surface thereof and upper and lower idler rollers 58 and 60, respectively, on the upper surface of strip 18. This arrangement provides the resultant advantages over prior art coil preparation systems of driven strip flattening to increase the radius of curvature of coiled strip passing therethrough as is advantageous with heavier gauge materials, as well as positive driving which, in addition to being advantageous with heavier gauge materials, is particularly useful in instances of a light gauge strip 18 as discussed hereinbefore.

The guide apron assembly 24 is carried by substructure 64 directly upstream from driven roller 22. Guide apron assembly 24 comprises a transversely extending plate member 68 having the downstream side thereof pivotally carried by substructure 64 and having the upstream side thereof being selectively vertically movable by a suitable extensible piston assembly 70. When the plate member 68 is in its up position the head end of strip 18 is directed to the vertical sideguide assembly 28 and when plate member 68 is in the down position thereof strip 18 is directed to the shear assembly 26. Strip 18 is directed to shear assembly 26 when it is necessary to further prepare the head end of strip 18. In this instance, the head end of strip 18 is suitably sheared such as the guillotine arrangement illustrated and the sheared end falls into scrap hopper 71.

Vertical sideguide assembly 28 comprises: a transversely spaced pair of sideguide 72 having an inwardly open generally "U" shaped cross section and an arcuate shaped vertical cross section; and a central support guide 74 located transversely intermediate sideguide 72. Guide 74 includes only a single downstream facing arcuate vertical wall and is stationary. Sideguides 72 each include a longitudinally spaced pair of arcuate vertical walls and are suitably carried, such as by a driven screw assembly 76, to be transversely movable with respect to mill centerline X—X. For purposes of illustration only, in FIG. 2 the sideguide 72 on the equipment side of mill centerline X—X is shown in the retracted position thereof which would permit the strip 18 to be pulled downstream and the sideguide 72 on the operation side of centerline X—X is shown in the inner position thereof where the sideguide 72 is guiding the strip 18 to the carryover sideguide assembly 30. It is understood that in all instances, the pair of vertical sideguides 72 will be transversely movable in tandum, specifically they will simultaneously move inwardly for guiding strip 18 and will simultaneously move outwardly for releasing strip 18.

The head end of strip 18 is driven by flattener roller 22 and directed by guide apron assembly 24 to the vertical sideguide assembly 28. The strip 18 passes upwardly through sideguide assembly 28 and is directed to carryover sideguide assembly 30. The vertically extending arcuate configuration of sideguides 72 conform generally to a preferred radius for strip 18 for vertical feeding and the outer surfaces of sideguides 72 provide edge control of strip 18 for proper orientation downstream. The vertical sideguide assembly 28 provides safe, efficient and accurate guiding of the strip 18 and the transversely movable sideguides 72 permit the strip 18 to be withdrawn from the assembly 28 for subsequent movement of the coil to the pass line mill deflector and pinch roll assembly 32.

Figure 3:
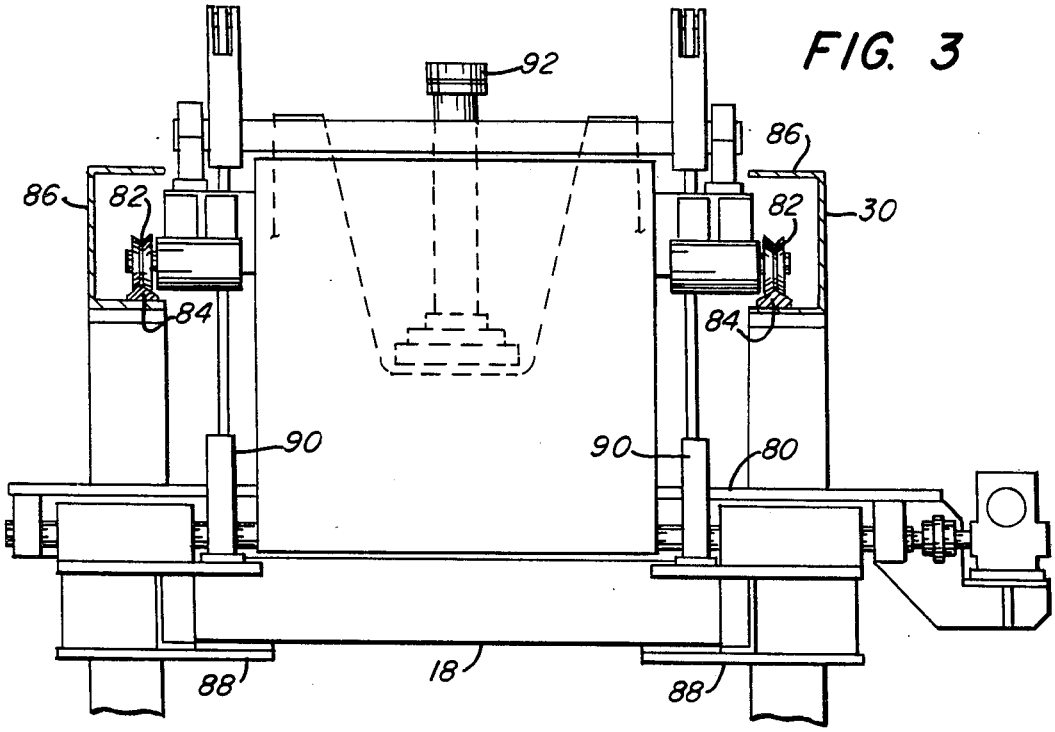
FIG. 3 is an end view of the carryover sideguides constructed in accordance with the principles of the present invention and taken on lines 3—3 of FIG. 1.
Figure 4:
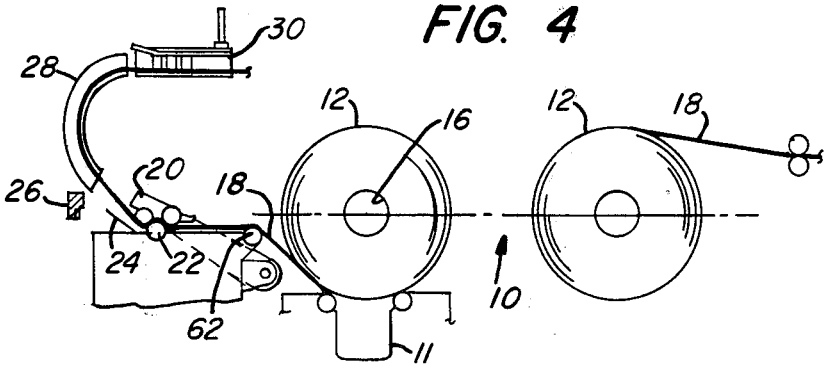
FIG. 4 is a schematic representation of a system of the present invention during an initial phase of coil preparation.

As illustrated in FIGS. 1 and 4, carryover sideguide assembly 30 is located adjacent vertical sideguide assembly 28 in the upstream position thereof. In the downstream position, as best seen in phantom in FIG. 1 and as shown in schematic in FIG. 5, assembly 30 is located adjacent mill deflector and pinch roll assembly 32. As best illustrated schematically in FIG. 3, carryover sideguide assembly 30 comprises an elevating, guiding and clamping sideguide portion 80 which is rendered longitudinally movable with respect to axis X—X by transversely spaced powered roller assemblies 82 which carry portion 80. For longitudinal movement roller assemblies 82 ride along rails 84 which are respectively seated on a transversely spaced pair of inwardly toed channel members 86. Channel members 86 are spaced upwardly from the coil preparation equipment described in detail hereinbefore.

It is to be noted that, except for the traversing feature and the upstream location, upper sideguides such as sideguide portion 80 have been used before. In such prior uses the upper sideguides were permanently located adjacent the deflector and pinch roll assembly 32. As illustrated, sideguide portion 80 includes a transversely spaced pair of horizontally extending inwardly open upper sideguide 88 which are transversely reciprocable with respect to axis X—X. Each sideguide 88 carries a vertically reciprocable strip clamp 90 thereon adjacent the downstream ends thereof. Sideguide portion 80 additionally includes a suitable extension cylinder assembly 92 which is operable to vertically reciprocate sideguides 88. The distance between the upper and lower walls of sideguides 88 is substantially the same as the distance between adjacent arcuate walls of sideguides 72.

With a structure of carryover sideguide 30 as described hereinabove, the head end of the strip 18 is guided through the vertical sideguide assembly 28 into the sideguides 88 of carryover sideguide assembly 30. Strip 18 is guided to a point adjacent the downstream end of sideguides 88 at which time clamps 90 are moved vertically downwardly to retain strip 18. The powered roller assemblies 82 are energized to move portion 80 forwardly or downstream to the feed position adjacent the deflector and pinch roll assembly 32. Vertical extension cylinder 92 is now energized to move the sideguides 88 downwardly so that the strip 18 is at the same vertical elevation as assembly 32. Strip 18 is fed to assembly 32, the clamps 90 are raised and sideguides 88 are traversed outwardly thereby releasing strip 18. Thus it can be seen that the longitudinally traversing arrangement of carryover sideguide assembly 30 provides a positive, safe and efficient means of guiding the strip 18 from the moment it exits the vertical sideguide assembly 28 until the strip 18 is actually fed to the processing machinery.

In summary, and in some instances amplification of the operation of a coil preparation system of the present invention, the following sequencing is noted:

1. A coil 12 is fed to the entry coil car 11.
2. The elevation of the entry coil car 11 is lowered to the preparation position.
3. The mandrel portion 38 is inserted into core 16 and expanded. Rollers 36 are now merely acting as idler rollers and thus the force of the vertical extension cylinders 34 may be reduced. Furthermore, the cylinders 34 are locked when traversing the coil 12 for it is noted that the elevation of the coil car 11 at the preparation position is the same as the elevation of coil car 11 at the downstream pay out position.
4. The coil opener support portion 48 is rotated clockwise until opener member 56 engages coil 12.
5. Mandrel portion 38 is rotated clockwise while member 56 "peels" off strip 18.
6. Support portion 48 is rotated counterclockwise until strip 18 is compressed between rollers 58 and 60 and driven roller 22 thereby simultaneously providing "flattening" and positive driving of strip 18.
7. If necessary guide apron assembly 24 is lowered to feed the strip to shearer assembly 26 to shear off an undesirable strip head end.
8. Guide apron assembly 24 is raised to guide strip 18 up through the vertical sideguide assembly 28 and then through the carryover sideguide assembly 30.
9. When strip 18 extends slightly downstream of sideguide 88, clamps 90 are energized to pinch strip 18 to the sideguides 88.
10. The mandrel portion 38 is withdrawn from core 16 and the vertical sideguides 72 are traversed outwardly to clear the strip 18.

Figure 5:
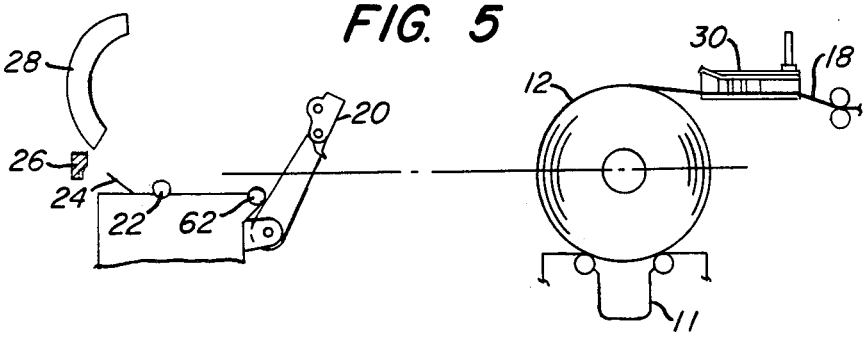
FIG. 5 is a schematic representation of a system of the present invention while starting to feed the strip from a newly prepared coil along the pass line to the mill production machinery.

11. Coil car 11 and carryover guide assembly 30 are traversed forwardly or downstream. Sideguides 88 of sideguide portion 80 are lowered until the head end of the strip 18 is pinched in assembly 32. Coil car 11 positions coil 12 in the final position thereof and feed reel mandrels (not shown) are received within the core 16. This position is schematically illustrated in FIG. 5.

12. Sideguides 88 are traversed outwardly and coil car 11 is lowered to clear the strip 18 and coil 12.

13. The coil car 11 and carryover guide assembly 30 are traversed rearwardly or upstream to receive the next coil 12 for preparation.

The invention herein is broadly directed to a method and apparatus for coil handling at a mill entry which provides improved sequencing and more positive handling. Accordingly, it is understood that various modifications may be made by those skilled in the art with respect to the embodiment described herein without departing from the scope of the invention, for example: differing retraction means may be provided for assemblies 14, 20, 28 and 30 if desired; carryover sideguide assembly 30 may be traversed by a monorail arrangement if desired; the central support guide 74 may be dispensed with and the sideguide 72 may be extended inwardly somewhat to provide additional support; and the like.

What is claimed is:

1. In a coil preparation apparatus for supporting and rotating a coil at a first location to pay out strip therefrom for strip preparation and subsequently guiding such strip and coil to a second location at a downstream mill pass line, the improvement comprising: first strip guide means spaced upstream from such a coil for the positive guiding of such strip throughout at least the major vertical portion of the travel thereof from the payout location of such strip from such a coil, which payout location is at a lower peripheral portion of such a coil, to on upper location spaced vertically upwardly from said payout location; said first strip guide means having upwardly extending vertical strip support and guiding portions which are selectively movable transversely of such strip to support and guide such strip at the first coil location and to thereafter release such strip from such support and guiding relationship when such strip is subsequently moved to such mill pass line; and second strip guide means adapted to receive and guide the head end of strip emerging from said first strip guide means at said upper location.

2. A coil preparation apparatus as specified in claim 1 wherein said second strip guide means comprises: clamping means for selectively retaining such strip; and orientating means for positioning such strip adjacent such mill pass line.

3. A coil preparation apparatus as specified in claim 2 including longitudinally extending support means spaced vertically upwardly from such coil, extending between such first and second position and supporting said second strip guide means therefrom; and said second strip guide means including longitudinal traverse portions which are cooperable with said support means to selectively move said second strip guide means longitudinally therealong.

4. A coil preparation apparatus as specified in claim 1 additionally including driven roller means intermediate said first strip guide means and such a coil and being operable to frictionally drive such strip through said first strip guide means.

5. In a coil preparation apparatus for supporting and rotating a coil at a first location to payout strip therefrom for strip preparation and subsequently guiding such strip to a second location at a downstream mill pass line, the improvement comprising: first strip guide means spaced upstream from such coil for guiding such strip upwardly; a guide apron assembly intermediate said first strip guide means and such a coil; said guide apron assembly being selectively operable in a first and second position; in said first position such strip being directed to a scrap shear assembly; and in said second position such strip being directed to said first strip guide means.

6. In a coil preparation apparatus for supporting and rotating a coil at a first location to pay out strip therefrom for strip preparation and subsequently guiding such strip and coil to a second location at a downstream mill pass line, the improvement comprising: first strip guide means spaced upstream from such coil for guiding such strip upwardly; said first strip guide means having upwardly extending strip support and guiding portions which are selectively movable transversely of such strip to support and guide such strip at the first coil location and to thereafter release such strip from such support and guiding relationship when such strip is subsequently moved to such mill pass line; and said strip supporting and guiding portions have a vertically extending arcuate configuration with the radius thereof being located downstream therefrom.

7. In a coil preparation apparatus for supporting and rotating a coil at a first location to payout strip therefrom for strip preparation and subsequently guiding such strip and coil to a second location at a downstream mill pass line, the improvement comprising: first strip guide means spaced upstream from such coil for guiding such strip upwardly; said first strip guide means having upwardly extending strip support and guiding portions which are selectively movable transversely of such strip to support and guide such strip at the first coil location and to thereafter release such strip from such support and guiding relationship when such strip is subsequently moved to such mill pass line; and a stripping assembly intermediate said first strip guide means and such a coil; said stripping assembly being selectively movable transversely in a first and second position; in said first position said stripping assembly engaging such coil and operable to peel the head end of strip therefrom and in said second position said stripping assembly being traversed outwardly to clear the path for such strip when such strip is moved to such mill pass line.

8. A coil preparation, apparatus as specified in claim 7 including a preparation mandrel assembly having a mandrel portion thereof being selectively movable transversely in a first and second position; in said first position said mandrel portion engaging the core of such coil in such first location and operable to support and rotate such coil and in said second position said mandrel being traversed outwardly to clear the path for such coil when such coil is moved to such mill pass line.

9. A coil preparation apparatus as specified in claim 7 additionally including driven roller means intermediate said first strip guide means and said stripping assembly and being operable to frictionally drive such strip through said first strip guide means.

10. A coil preparation apparatus as specified in claim 9 wherein in said first position said stripping assembly is selectively pivotable into a stripping position and a driving position; in said stripping position said stripping assembly engaging such coil to peel the head end of strip therefrom; and in said guiding position roller means carried by said stripping assembly are cooperable with said driven roller means to frictionally drive such strip.

11. In a coil preparation apparatus wherein an entry coil car positions a coil in a first location to payout strip therefrom for strip preparation and subsequently moves such coil to a second location at a downstream mill pass line, the improvement comprising: in said first location and during movement of said entry coil car to said second location, such coil is at least partially supported by idler rolls of said entry coil car; a preparation mandrel assembly having a mandrel portion thereof being selectively movable in a first and second position; in said first position said mandrel portion engaging the core of such coil at said first location and operable to rotate and at least partially support such coil to pay out strip therefrom for strip preparation; in said second position said mandrel portion being traversed outwardly to clear the path for such coil when said entry coil car and such coil carried thereby is moved to said second location; and in said first location and during such movement between said first and second locations, said entry coil car, said idler rolls and such coil carried thereby remain at a constant uniform elevation.

12. In a coil preparation apparatus wherein a stripping assembly is operable to peel strip from a coil being prepared at a first location for subsequent guiding of such strip to a second location at a downstream mill pass line the improvement comprising: driven roller means upstream of said stripping assembly and being operable to frictionally drive such strip for at least a portion of such subsequent guiding; said stripping assembly including peeling means adjacent a downstream portion thereof and roller means adjacent an upstream portion thereof; said stripping assembly being selectively pivotable in a stripping position and a guiding position; in said stripping position said peeling means engaging such coil to peel strip therefrom; and in said guiding position said roller means being cooperable with said driven roller means to pinch such strip therebetween for a positive frictional driving of such strip.

13. A method of preparing coil at a single upstream preparation location and subsequently moving said coil to a downstream location at mill pass line equipment comprising the steps of: peeling a head end portion of strip from said coil at said single upstream location; guiding said head end portion of said strip to a first location located upwardly of said coil and upstream of said downstream location; clamping said strip at said first location; maintaining said coil at said single upstream location during said peeling, said guiding and said clamping; moving said head end portion of said strip and said coil from said single upstream location and said first location to said downstream location; during said moving, maintaining said clamping; feeding said head end portion of said strip to the entry of said mill pass line equipment; and releasing said clamping.

14. A method as specified in claim 13 including the additional step of frictionally driving said head end portion of said strip during at least a portion of said guiding.

15. A method as specified in claim 13 including selectively guiding said head end of said strip to a scrap shear for additional preparation and thereafter guiding said strip to said first location.

* * * * *